United States Patent [19]

Lopez-Crevillen et al.

[11] Patent Number: 5,063,737

[45] Date of Patent: Nov. 12, 1991

[54] PARTICULATE TRAP SYSTEM FOR AN INTERNAL COMBUSTION ENGINE

[75] Inventors: Jose M. Lopez-Crevillen, Westland; Arjun D. Tuteja, Novi, both of Mich.

[73] Assignee: General Motors Corporation, Detroit, Mich.

[21] Appl. No.: 575,915

[22] Filed: Aug. 31, 1990

Related U.S. Application Data

[63] Continuation-in-part of Ser. No. 428,387, Oct. 27, 1989, Pat. No. 4,987,738.

[51] Int. Cl.[5] ..... F01N 3/02

[52] U.S. Cl. ..... 60/286; 60/288; 60/303

[58] Field of Search ..... 60/286, 288, 303, 311; 55/466, DIG. 30

[56] References Cited

U.S. PATENT DOCUMENTS

| | | | |
|---|---|---|---|
| 4,381,643 | 5/1983 | Stark | 60/303 |
| 4,383,411 | 5/1983 | Riddell | 60/303 |
| 4,419,113 | 12/1983 | Smith | 55/484 |
| 4,481,767 | 11/1984 | Stark | 60/303 |
| 4,502,278 | 3/1985 | Stark | 60/303 |
| 4,503,672 | 3/1985 | Stark | 60/286 |
| 4,558,565 | 12/1985 | Kojima | 60/286 |
| 4,677,823 | 7/1987 | Hardy | 60/274 |
| 4,686,827 | 8/1987 | Wade | 60/286 |

FOREIGN PATENT DOCUMENTS

| | | | |
|---|---|---|---|
| 126017 | 7/1984 | Japan | 60/288 |

*Primary Examiner*—Douglas Hart

*Attorney, Agent, or Firm*—Karl F. Barr, Jr.

[57] ABSTRACT

A particulate trap system for use in the exhaust system of an internal combustion engine has an exhaust conduit with a main branch, a bypass branch, and an exhaust pressure regulating valve disposed within the main branch for selectively diverting exhaust gas through one of the branches. A particulate filter is disposed within the main branch and a burner assembly, having an outlet disposed upstream of the filter, is operable to raise the temperature of the filter to a level sufficient to incinerate particulates thereon. The exhaust pressure regulating valve is configured to act as a metering orifice when in a restrictive position so as to supply a metered amount of exhaust air to the burner while channeling a substantial portion of the exhaust flow through the bypass branch during the regeneration cycle of the system. A pressure relief valve disposed within the bypass branch maintains substantially constant pressure within the exhaust conduit thereby assuring a substantially constant flow of exhaust gas through the metering portion of the exhaust pressure regulating valve and into the burner assembly.

12 Claims, 3 Drawing Sheets

ECM
58
PRESS. SENSOR
SOL. V
EIU
IGNIT COIL
DIFF. P. SENSOR
FUEL PUMP
36
SOL. V
FUEL SUPPLY
AIR P. REG.
38
46
12
54
56
SOL. V
14
18
24
22
16
10
20
44
42
43
40
30
34
28
32
26
60
52
48
50
80
82
70
85
68
86
66
64
88
62

PARTICULATE TRAP SYSTEM FOR AN INTERNAL COMBUSTION ENGINE

This is a continuation-in-part of Ser. No. 428,387, filed on Oct. 27, 1989 now U.S. Pat. No. 4,987,738 and incorporated herein by reference.

BACKGROUND OF THE INVENTION

1. Field of the Invention

The present invention relates to a particulate trap system for an internal combustion engine which supplies a substantially constant flow of exhaust gas to the burner during regeneration.

2. Description of the Relevant Art

Particulate trap oxidizer configurations demonstrated as conceptually feasible generally utilize a burner disposed upstream of a particulate trap to heat entering exhaust gas to a temperature sufficient to burn particulates which have accumulated on the trap during engine operation. These systems may require valve assemblies to divert, modulate, or restrict exhaust flow to the burner as well as air-fuel sub-systems to support efficient combustion within the particulate trap. The subsystems monitor engine operating conditions such as speed and load in order to vary air-fuel mixtures according to changing exhaust gas flow and temperature, since control of temperature is needed for efficient regeneration and extended filter life. As a result, large and complex burner and air-fuel systems are often required, resulting in packaging and reliability concerns.

SUMMARY OF THE INVENTION

In accordance with the present invention, an exhaust cleaner and burner system for use in the exhaust system of an internal combustion engine is disclosed. The system comprises an exhaust filter through which exhaust gas passes and a burner having an outlet disposed upstream of the filter and operable to raise the temperature of the filter to burn particulates trapped thereon thereby regenerating the filter. The burner has an air-fuel mixture apparatus which utilizes a fuel pump for delivery of fuel to an injector and an air pump for delivering atomizing air to the injector thereby assuring fuel ignition during regeneration. To minimize the size and complexity of the burner and its associated air-fuel system, a supplemental air source comprising metered exhaust gas, supplies overall combustion air to the burner. The exhaust gas has sufficient oxygen present, especially in diesel applications, to allow complete combustion of burner supplied fuel and, as such, dispenses with the necessity of a large blower to supply the full requirement of combustion air. An exhaust conduit transfers exhaust gas from the engine to the burner and has an exhaust pressure regulating valve (EPR) disposed therein, upstream of the burner, which acts to meter exhaust gas flow through the burner during the filter regeneration event. The EPR valve may be of the butterfly type having a metering orifice therein. The orifice provides limited exhaust flow to the burner when the EPR valve is in a restricted position. A bypass conduit extends from a position upstream of the EPR valve and acts to divert exhaust gas not passing through the metering orifice around the burner-filter assembly during filter regeneration. A pressure relief valve is situated within the bypass conduit and operates to maintain a predetermined back pressure within the exhaust conduit thereby maintaining a substantially constant exhaust flow through the EPR valve metering orifice when the EPR valve is in a restricted position during the filter regeneration event. The pressure relief valve comprises a pintle valve, or the like, which is biased to a normally closed position. During the filter loading mode, when the EPR valve is in a nonrestrictive position, the pressure relief valve is locked in the closed position to ensure that all of the exhaust gas exiting the engine passes through the filter. Additionally, potentially destructive valve flutter caused by exhaust pressure pulsations within the exhaust conduit is eliminated by locking the pressure relief valve in the closed position The locking mechanism comprises a vacuum actuated cam mechanism which contacts the pintle valve stem to maintain the valve in the desired closed position.

Also, during normal engine operation, the EPR valve is maintained in a fully opened position allowing exhaust gas to be channeled through the filter means prior to release to the atmosphere. A controller actuates the EPR valve and simultaneously unlocks the pressure relief valve cam locking mechanism once a predetermined pressure is reached upstream of the filter which is indicative of an undesirable level of particulate accumulation thereon. The controller, acting on information received from pressure sensors disposed throughout the system, moves the EPR valve to a restricted position causing exhaust back pressure upstream of the valve to increase to a point sufficient to overcome the bias of the unlocked pressure relief valve disposed within the bypass branch. Upon reaching this pressure, the pressure relief valve opens and exhaust gas is channeled through the bypass branch. A fuel pump is actuated to supply fuel to the burner where it is atomized by pressurized air from an air pump and is ignited by a spark plug or other ignitor means disposed within the burner. Following ignition, the burning air-fuel mixture combines with the metered exhaust gas supply entering the burner through the metering orifice in the EPR valve. The temperature of the exhaust gas supply is raised to a temperature sufficient to incinerate the particulates collected on the filter medium, thereby regenerating the filter. Following the regeneration event, the EPR valve is moved to a fully opened position and, simultaneously, the cam mechanism is actuated to lock the pressure relief valve in the closed position thereby channeling exhaust flow through the filter.

The present invention provides an exhaust cleaner and burner system having an air-fuel system of reduced size and complexity. The maintenance of a substantially constant exhaust air flow through the burner eliminates the need for a burner with an air-fuel system capable of operating under widely varying exhaust air flow volumes. As a result, durability, reliability, and minimization of size and complexity of the system can be achieved.

Other objects and features of the invention will become apparent by reference to the following description and to the drawings.

DESCRIPTION OF THE PREFERRED EMBODIMENT

Figures 1, 2A, 2B:
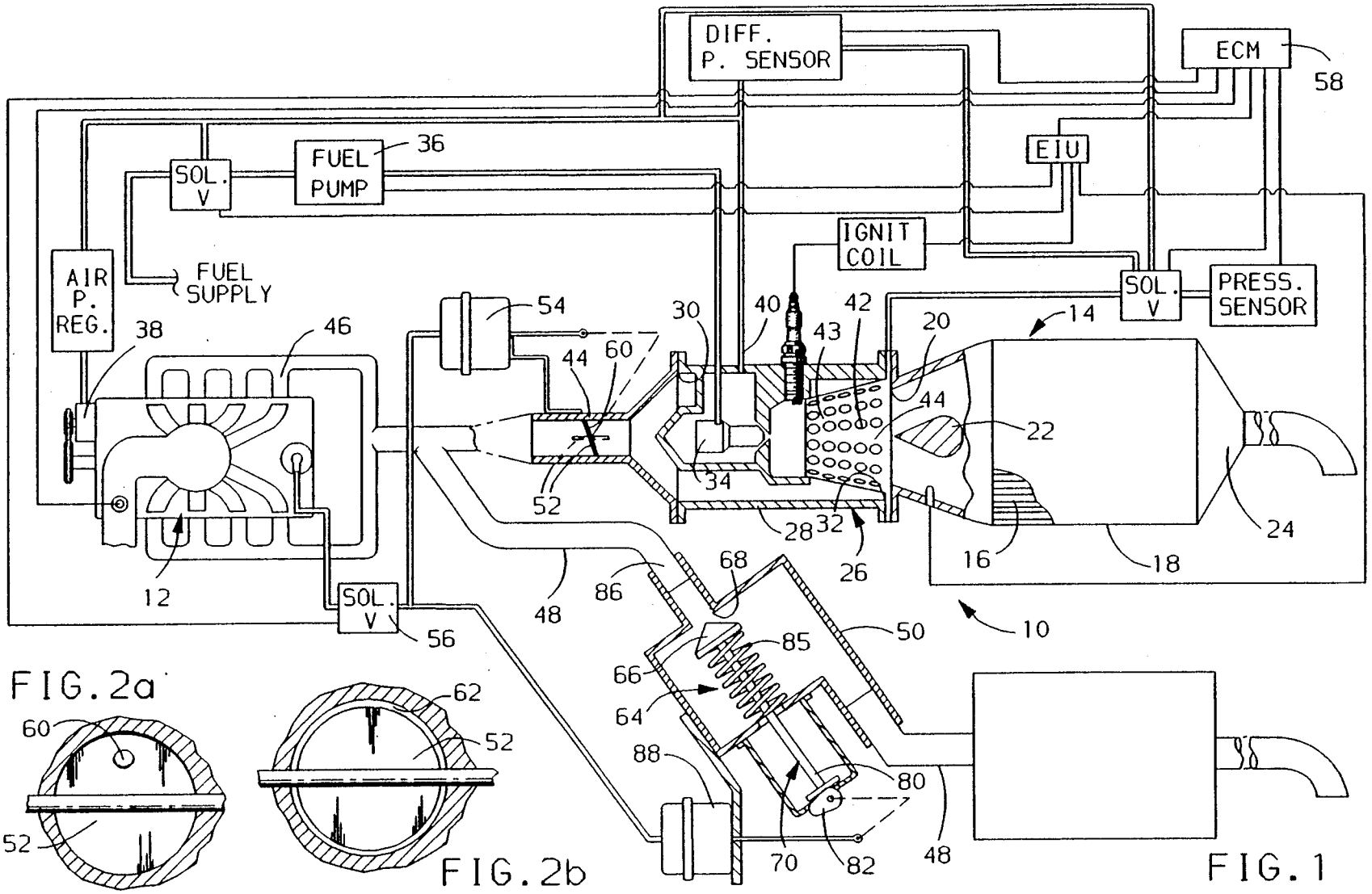
FIG. 1 is a schematic view of one embodiment of an exhaust cleaner and burner system embodying the present invention.
FIGS. 2*a* and 2*b* are partial sectional views of two embodiments of the exhaust pressure regulating valve employed in the exhaust cleaner and burner system of FIG. 1.

In FIG. 1 there is shown an exhaust cleaner and burner system, designated generally as 10, for use in the exhaust system of an internal combustion engine, such as diesel engine 12, to remove particulates present in exhaust gas emitted from the engine. The system comprises an exhaust filter assembly 14 having a filter 16 supported within a rigid canister 18. The canister has an inlet 20, an inlet diffuser 22 disposed within the inlet to uniformly distribute exhaust flow across the inlet face of filter 16 to assure efficient distribution of particulates within the filter, and an outlet 24. The canister 18 is generally of a corrosion resistant steel such as stainless steel or other suitable material. Filter 16 is a monolithic filter constructed of porous ceramic, or any other suitable high temperature material, which is capable of collecting minute particulates carried by exhaust gas passing therethrough, while imposing relatively low exhaust flow restriction on engine 12. The material has high temperature characteristics which enable it to withstand the thermal stress imposed by repeated regeneration cycles, to be described in further detail below, without a loss of physical integrity or filtration efficiency. Filter 16 is supported within canister 18 utilizing well-known mounting techniques.

To regenerate the filter, a burner is employed to incinerate particulates deposited thereon. A burner apparatus, designated generally as 26, is mounted with its outlet upstream of filter 16. Burner apparatus 26 comprises an axial flow burner having an outer tubular shell 28 with an inlet 30 and an outlet 32 connecting the apparatus to the inlet 20 of filter canister 18. Centrally disposed within burner shell 28 is fuel nozzle 34 for introducing fuel into the combustion chamber 42 during regeneration. Fuel pump 36 supplies fuel to nozzle 34 and an engine driven, positive displacement air pump 38 provides clean, high oxygen content air to nozzle 34 through air line 40 for atomization of the fuel. The air-fuel mixture is injected into combustion chamber 42 where it is mixed with exhaust gas passing through the axial flow burner (to be described in further detail below) thereby raising the temperature of the exhaust gas to a level sufficient to incinerate particulates trapped on filter 16. In order to reduce back pressure as exhaust gas passes through, axial burner 28, the burner chamber wall 43 is configured to have a substantially conical shape thereby increasing wall flow area. To conduct exhaust gas into burner apparatus 26 for subsequent introduction into filter canister 18, exhaust conduit 44 extends between exhaust manifold 46 of engine 12 and the inlet 30 of burner apparatus 26. A bypass branch 48 extends from a position upstream of burner apparatus 26 and has a pressure relief valve 50 for controlling the flow of exhaust gases therethrough.

In order to minimize the size and complexity of burner apparatus 26, it is desirable to maintain a substantially constant flow rate of combustion air through the burner during the regeneration of filter 16 regardless of engine operating conditions. Such a flow rate eliminates the need for systems to vary fuel flow in response to wide variations in combustion air flow through the burner. In the present invention, combustion air, over and above that supplied by air pump 38 for atomization purposes, is supplied to burner apparatus 26 in the form of exhaust gas exiting diesel engine 12 through exhaust conduit 44. An exhaust pressure regulating valve (EPR) 52 is disposed within exhaust conduit 44 and is actuable to meter the flow of exhaust gas through conduit 44 and into burner 26 during regeneration. The EPR valve is operated by vacuum actuator 54 which is in turn controlled by solenoid valve 56 which acts on command of electronic control module (ECM) 58. During filter loading, EPR valve 52 is maintained in a nonrestrictive position as shown in phantom in FIG. 1. Once conditions necessitate regeneration of filter 16, EPR valve 52 is moved to a restrictive position, shown in FIG. 1, so as to meter exhaust gas flowing through the burner 26 to a substantially constant flow.

As shown in FIGS. 2*a* and 2*b*, EPR valve 52 may employ various configurations in order to meter the flow of exhaust gas through burner 26. In FIG. 2*a*, a metering orifice 60 is formed in the face of valve 52 thereby allowing only a predetermined amount of exhaust gas into burner 26 when EPR valve 52 is in a fully restricted position and exhaust pressure upstream of the valve remains substantially constant. In FIG. 2*b*, EPR valve 52 is sized so as to form a peripheral metering gap 62 between the outer circumference of the valve and internal diameter of exhaust conduit 44. The peripheral gap 62 acts to meter the supply of exhaust gas entering burner 26 when valve 52 is moved to its restricted position and exhaust pressure upstream of the valve remains substantially constant. In either configuration, the orifice 60 or the peripheral gap 62 meters the exhaust flow into the burner during regeneration.

The exhaust flow supplied through exhaust conduit 44 enters burner apparatus 26 at inlet 30 and it is channeled, through burner shell 28, to combustion chamber 42 where it is mixed with the burning air-fuel mixture. Subsequently, the hot gas exits burner apparatus 26 through outlet 32 and enters filter canister 18 to regenerate filter 16.

Figure 3:
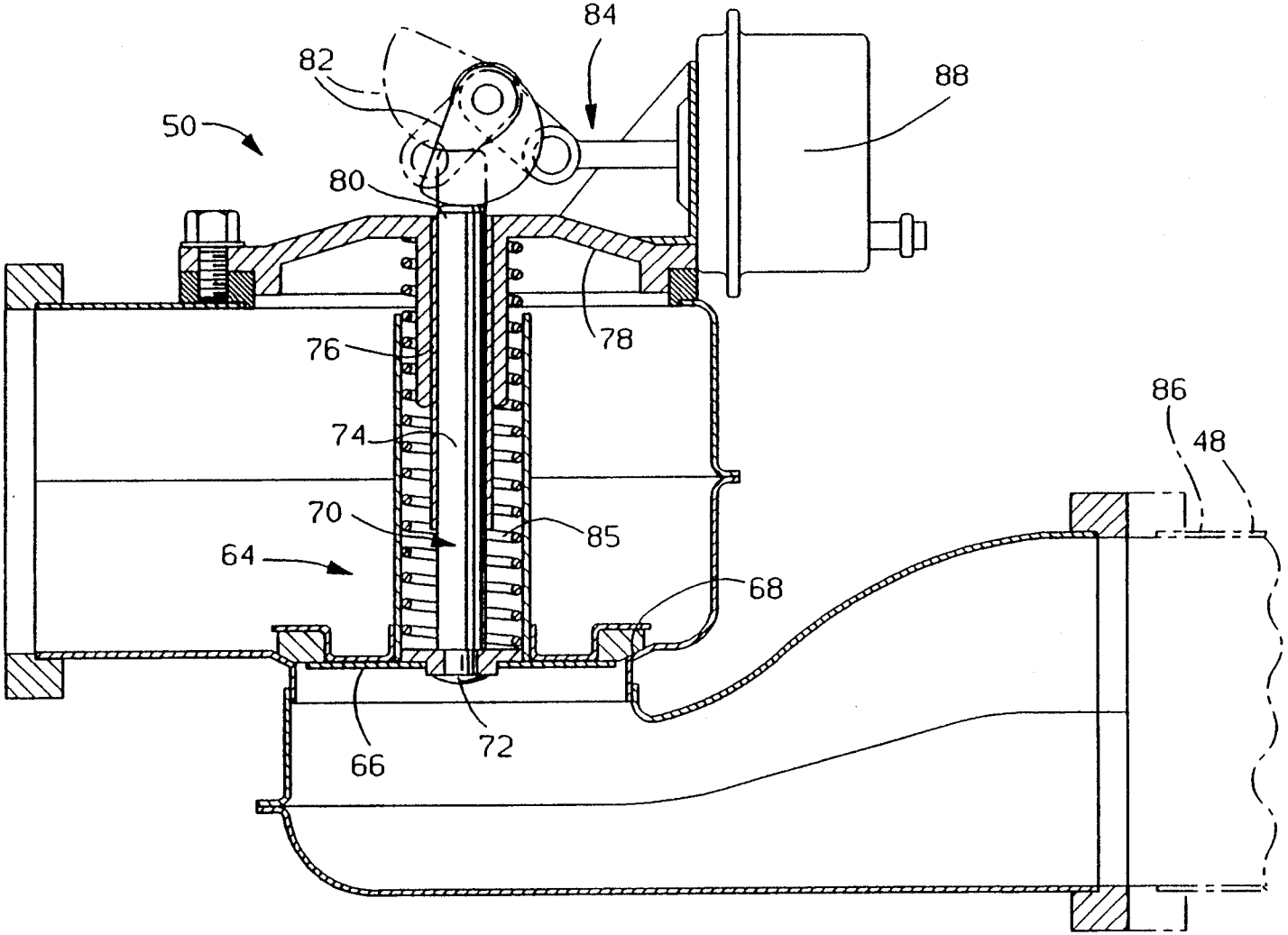
FIG. 3 is a sectional view of a pressure relief valve employed in the exhaust cleaner and burner system of FIG. 1.

To assure a substantially constant flow rate through EPR valve 52, exhaust gas pressure at the inlet of the orifice 60 or metering gap 62 must be maintained substantially constant. To this end, pressure relief valve 50 disposed within bypass branch 48 acts, following movement of EPR valve 52 to the restricted position, to close the path of the exhaust gas passing through bypass branch 48 thereby increasing pressure within the system upstream of EPR valve 52. Once a predetermined pressure is achieved, pressure relief valve 50 opens to allow exhaust to flow freely through bypass system 48. Pressure relief valve 50 (shown in FIG. 3) comprises a valve member 66 mounted adjacent valve seat 68, and a valve stem 70 having a first end 72 from which valve member 66 extends, a central portion 74, guided by sleeve 76 of pintle valve supporting bracket 78, and a second end 80 for engagement with cam member 82 of cam lock assembly 84. Valve member 66 is normally biased to a closed position as shown in FIG. 3 by a biasing member such as spring 85 which has a rate which is chosen to maintain the valve member in a seated position relative to valve seat 68 until a predetermined back pressure exists within the upstream portion 86 of bypass branch 48. Once back pressure within upstream portion 86 exceeds the predetermined level, the valve member will open and bypass exhaust gas to the downstream portion of bypass branch 48.

The operation of the valve member described above assumes that the cam member 82 of cam lock assembly 84 is placed in the unlocked position shown in phantom in FIG. 3. In this position, clearance exists between the second end 80 of valve stem 70 and the cam member 82 thereby allowing the pintle valve 64 to move freely between the valve closed position shown in FIG. 3 and a valve opened position shown in phantom in FIG. 3. As a result, pintle valve 64 acts, when cam member 82 is in the open position, to maintain a constant upstream exhaust pressure upstream thereby allowing a constant exhaust flow to be maintained through orifice 60 or peripheral gap 62 of EPR valve 52 during trap regeneration.

Although spring 85 operates to bias pintle valve 64 towards a closed position during trap loading, it is desirable to lock the pintle valve in the closed position during this time to ensure that all of the exhaust gas exiting engine 12 passes through filter 16. To achieve this, the electronic control module 58 signals solenoid valve 56 to operate vacuum actuator 88 and move cam member 82 into the lock position shown in FIG. 3 when vacuum actuator 54 is operated to move EPR valve 52 into the nonrestrictive position shown at FIG. 1. The actuator maintains the cam 82 in the lock position until the ECM 58 determines the need for a subsequent regeneration event at which time it again issues the simultaneous order to solenoid valve 56 to operate actuators 54 and 88 to move EPR valve 52 into a restricted position and to move the cam lock mechanism 82 to the unlocked position, respectively. Additionally, by locking the pintle valve 64 in the fully closed position during filter loading, vibration of the pintle valve, caused by exhaust pressure pulsations in the exhaust conduit upstream of the valve, is prevented. The elimination of pintle valve vibration prevents unnecessary wear of the valve member 66 and reduces system noise.

Figure 4:
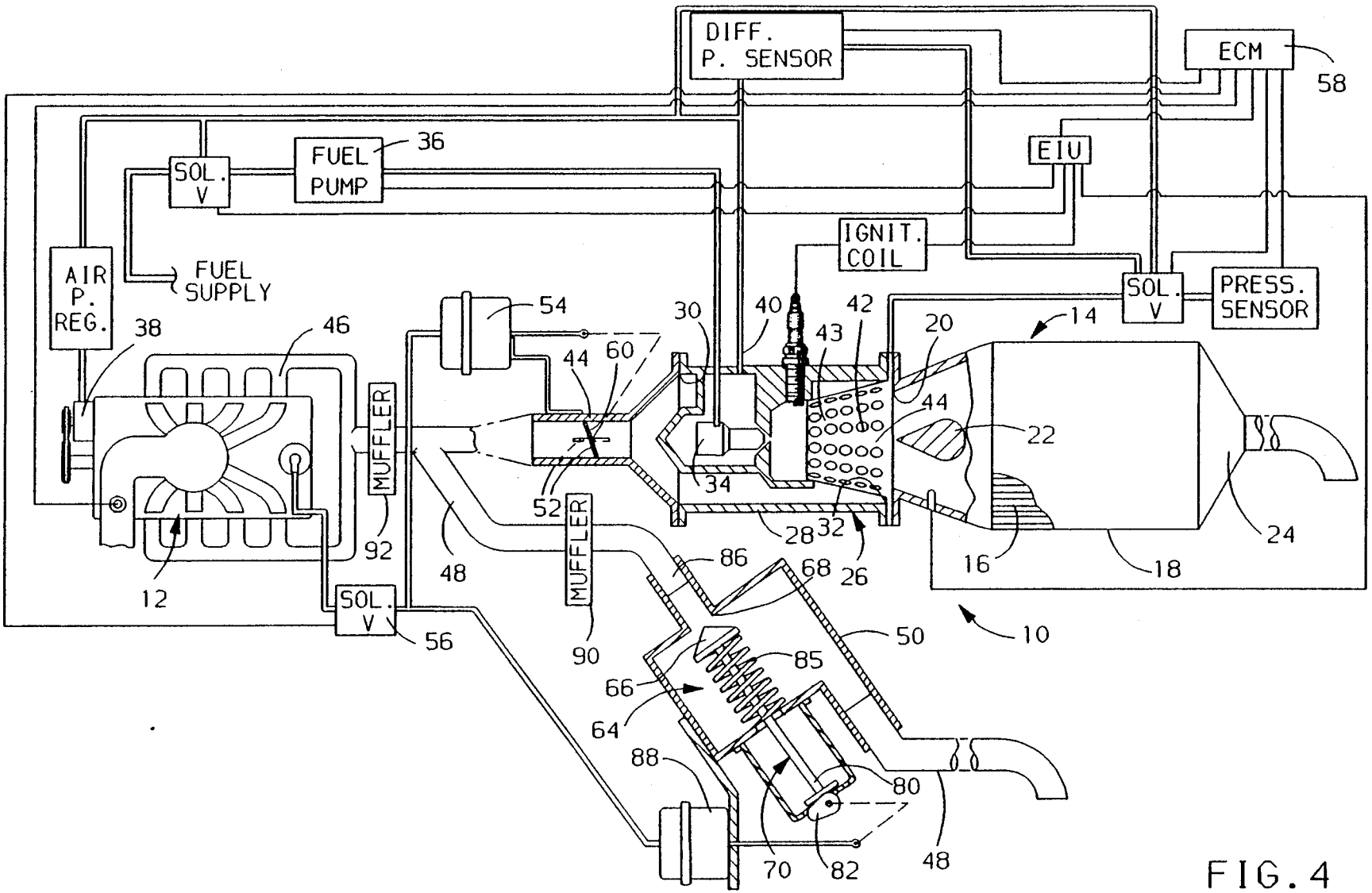
FIG. 4 is a second embodiment of the exhaust cleaner and burner system embodying the present invention.

To further reduce the effects of exhaust pressure pulsations on the operation of pressure relief valve 50 and burner apparatus 26, a second embodiment of the exhaust cleaner and burner system, shown in FIG. 4, is contemplated. In this embodiment, mufflers 90 and 92 are placed upstream of both pressure relief valve 50 and burner apparatus 26. It should be understood, that due to the noise attenuating effect of filter 16 and other components in the burner apparatus, less noise attenuation is required in the burner-filter branch of the system than is required by the bypass branch of the system. Placement of a single muffler capable of adequately attenuating both the burner branch and the bypass branch at the position of muffler 92 would over attenuate the system during filter loading thereby causing undue back pressure to be imposed on engine 12. As a result, muffler 92, if required at all, is configured to operate at a level sufficient to attenuate the burner branch of the exhaust system shown in FIG. 4. Additional sound attenuation required within bypass branch 48 is provided by muffler 90. As indicated above, the effect of the mufflers 90, 92 is to dampen exhaust system pressure pulsations upstream of the EPR valve 52 and pressure relief valve 50 thereby minimizing the effects of the pulsations on the operation of the overall system.

The exhaust cleaner and burner system of the present invention is an efficient solution to the regeneration of particulate filters used with internal combustion engines, namely diesel engines. Through the use of an orifice metered exhaust gas supply, and a pressure relief valve for maintaining substantially constant pressure at the entrance to the metering orifice, substantially constant combustion air flow can be assured through the burner apparatus. As a result, the need for varying burner operation dependent upon wide variations in engine speed and load and, consequently, exhaust flow is eliminated.

Additionally, the use of the bypass system for a substantial portion of engine exhaust during regeneration dispenses with the need to heat the entire exhaust flow during regeneration. As a result, a smaller, more efficient fuel-air burner system may be used.

While certain embodiments of the invention have been described in detail above in relation to an exhaust cleaner and burner system, it would be apparent to those skilled in the art that the disclosed embodiment may be modified. Therefore, the foregoing description is to be considered exemplary, rather than limiting, and the true scope of the invention is that defined in the following claims.

The embodiments of the invention in which an exclusive property or privilege is claimed are defined as follows:

1. An exhaust cleaner and burner system for use in the exhaust system of an internal combustion engine comprising:

exhaust filter means having an inlet and an outlet;

a burner, having an outlet upstream of said filter means and operable to raise the temperature of said filter means;

an exhaust conduit for conducting exhaust gas from the engine to the inlet of said burner;

an exhaust pressure regulating valve disposed within the exhaust conduit, upstream of said burner, and actuable to restrict exhaust gas flow through said burner and raise the pressure upstream of said valve;

a bypass conduit for diverting exhaust gas around said burner and filter means when said exhaust pressure regulating valve is in said restricted position;

a pressure relief valve disposed within said bypass conduit having a valve member biased towards a normally closed position and a locking means positionable in a first, locked mode to maintain said valve in said normally closed position and a second, unlocked mode to allow said valve to open against said biasing means;

control means operable to position said EPR valve in a nonrestrictive position and said locking means of said pressure relief valve in said locked mode to direct exhaust gas exiting the engine through said filter means, and operable to position said exhaust pressure regulating valve in said restrictive position and said locking means of said pressure relief valve in an unlocked position to restrict the flow of exhaust gas through said burner and said filter means thereby increasing exhaust system pressure upstream of said exhaust pressure regulating valve to a predetermined level sufficient to overcome said pressure relief valve and allow exhaust gas to enter said bypass conduit;

wherein said pressure relief valve maintains a predetermined pressure in said exhaust conduit upstream of said exhaust pressure regulating valve to provide a substantially constant supply of exhaust gas to said burner through said restricted exhaust pressure regulating valve.

2. An exhaust cleaner and burner system for use in the exhaust system of an internal combustion engine, as defined in claim 1, said exhaust filter means further comprising a wall flow ceramic monolith filter supported within a rigid canister having an inlet and an outlet.

3. An exhaust cleaner and burner system for use in the exhaust system of an internal combustion engine, as defined in claim 1, said burner comprising an axial flow burner having an outer tubular shell with an inlet connected to said exhaust conduit an outlet connected to said inlet of said exhaust filter means and a burner assembly mounted within said tubular shell;

said shell establishing a path for exhaust gas passing from said exhaust conduit to said filter means.

4. An exhaust cleaner and burner system for use in the exhaust system of an internal combustion engine, as defined in claim 3, said burner further comprising a substantially conical burner chamber wall to increase wall flow area and reduce back pressure.

5. An exhaust cleaner and burner system for use in the exhaust system of an internal combustion engine, as defined in claim 1, said exhaust pressure regulating valve comprising a butterfly-type valve having an exhaust gas metering orifice for metering the flow of exhaust gas to said burner when said valve is in said restrictive position.

6. An exhaust cleaner and burner system for use in the exhaust system of an internal combustion engine, as defined in claim 1, said exhaust pressure regulating valve comprising a butterfly-type valve which forms a peripheral gap between said valve and the inner wall of said exhaust conduit for metering the flow of exhaust gas to said burner when said valve is in said restrictive position.

7. An exhaust cleaner and burner system for use in the exhaust system of an internal combustion engine, as defined in claim 1, said pressure relief valve further comprising a normally closed, spring biased pintle valve having a cam locking mechanism actuable to a first locked position to engage and retain said valve in said normally closed position and actuable to a second unlocked position to release said valve.

8. An exhaust cleaner and burner system for use in the exhaust system of an internal combustion engine, as defined in claim 7, said pressure relief valve further comprising a vacuum diaphragm actuator for operating said cam locking mechanism.

9. An exhaust cleaner and burner system for use in the exhaust system of an internal combustion engine, as defined in claim 1, further comprising a muffler mounted within said bypass conduit upstream of said pressure relief valve for damping exhaust pressure pulsations impending on said valve and attenuating noise in said bypass conduit.

10. An exhaust cleaner and burner system for use in the exhaust system of an internal combustion engine, as defined in claim 9, further comprising a muffler mounted within said exhaust conduit upstream of said exhaust pressure regulating valve and said bypass branch for damping exhaust pressure pulsations and attenuating noise in said exhaust conduit.

11. An exhaust cleaner and burner system for use in the exhaust system of an internal combustion engine comprising:

exhaust filter means having an inlet and an outlet;

a burner, having an outlet upstream of said filter means and operable to raise the temperature of said filter means;

an exhaust conduit for conducting exhaust gas from the engine to the inlet of said burner;

a bypass conduit for diverting exhaust gas around said burner and filter means when said burner is operated to regenerate said filter means;

valve means disposed within said exhaust conduit and said bypass conduit for regulating the flow of exhaust gas through said exhaust cleaner and burner system; and exhaust pressure pulsation and sound attenuating means disposed within said bypass conduit, upstream of said valve means, for reducing exhaust pressure pulsations incident on said valve means and for reducing noise emanating from said system.

12. An exhaust cleaner and burner system for use in the exhaust system of an internal combustion engine comprising:

exhaust filter means having an inlet and an outlet;

a burner, having an outlet upstream of said filter means and operable to raise the temperature of said filter means;

an exhaust conduit for conducting exhaust gas from the engine to the inlet of said burner;

a bypass conduit for diverting exhaust gas around said burner and filter means when said burner is operated to regenerate said filter means;

valve means disposed within said exhaust conduit and said bypass conduit for regulating the flow of exhaust gas through said exhaust cleaner and burner system; and exhaust pressure and sound attenuating means disposed within said exhaust conduit, upstream of said valve means, for reducing exhaust pressure pulsations incident on said valve means and for reducing noise emanating from said system.

* * * * *